US008985076B1

(12) United States Patent
Kim et al.

(10) Patent No.: US 8,985,076 B1
(45) Date of Patent: Mar. 24, 2015

(54) VALVE LASH ADJUSTMENT DEVICE

(71) Applicant: Brunswick Corporation, Lake Forest, IL (US)

(72) Inventors: Bo K. Kim, Fond du Lac, WI (US); Christopher R. Jenks, Rosendale, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/922,760

(22) Filed: Jun. 20, 2013

Related U.S. Application Data

(60) Provisional application No. 61/786,979, filed on Mar. 15, 2013.

(51) Int. Cl.
*F01L 1/18* (2006.01)
*F01L 1/12* (2006.01)

(52) U.S. Cl.
CPC ..... *F01L 1/12* (2013.01)
USPC ..... 123/90.46; 123/90.45

(58) Field of Classification Search
CPC ..... F01L 1/2405
USPC ..... 123/90.45, 90.46, 90.52–90.59, 123/90.62–90.63
See application file for complete search history.

(56) References Cited

U.S. PATENT DOCUMENTS 3,791,355 A 2/1974 Bergmann et al.
4,241,707 A * 12/1980 Mayr et al. ..... 123/90.55
5,010,856 A 4/1991 Ojala
5,347,964 A 9/1994 Reguiero
5,595,149 A * 1/1997 Speil et al. ..... 123/90.55
5,806,477 A 9/1998 Regueiro
7,089,900 B2 8/2006 Masello et al.
7,383,799 B1 6/2008 Wynveen et al.
7,464,678 B2 12/2008 Rozario et al.
7,464,679 B2 12/2008 Sailer et al.
7,845,327 B2 12/2010 Tallio et al.
7,992,532 B2 8/2011 Bugescu et al.
8,056,518 B1 * 11/2011 Novak et al. ..... 123/90.16
8,210,144 B2 7/2012 Langewisch
2009/0056653 A1 * 3/2009 Schmidt et al. ..... 123/90.16
2009/0159028 A1 * 6/2009 Douse et al. ..... 123/90.46
2011/0000451 A1 1/2011 Kraus
2011/0011361 A1 1/2011 Roberts

* cited by examiner

*Primary Examiner* — Thomas Denion
*Assistant Examiner* — Daniel Bernstein
(74) *Attorney, Agent, or Firm* — Andrus Intellectual Property Law, LLP

(57) ABSTRACT

A lash adjustment device is for a valve train in a marine engine. The lash adjustment device comprises an external hollow body and a ball shaft that is telescopically movable in the hollow body. The ball shaft has a through-bore for receiving oil and having an annular lower end surface and an upper end surface. Oil flow into the hollow body pushes on the lower end surface and forces the ball shaft to telescope outwardly with respect to the hollow body. An absence of oil flow in the hollow body allows the ball shaft to telescope inwardly with respect to the hollow body until the annular lower end surface engages with an internal stop surface formed in the hollow body.

1 Claim, 6 Drawing Sheets

VALVE LASH ADJUSTMENT DEVICE

CROSS REFERENCE TO RELATED APPLICATION

The present U.S. utility patent application claims the benefit of and priority to U.S. Provisional Patent Application Ser. No. 61/786,979, filed Mar. 15, 2013

FIELD

The present disclosure relates to engine valve systems and more particularly to valve lash adjustment devices.

BACKGROUND

U.S. Pat. No. 8,056,518, which is incorporated herein by reference in entirety, discloses a valve actuating system that determines a shape of its jam nut surface as a function of a resultant force on a ball stud exerted by a rocker arm on the ball stud during operation of the valve train. The contact surface of the jam nut, which is pressed against an associated surface of the head of an engine, is a conical surface with an included angle that is generally twice the magnitude of an angle between a resultant force on the ball stud and a central axis of the ball stud and its associated jam nut. Certain accommodations can be made in order to reduce the cost of the system that would occur if perfect mathematical preciseness with a most preferred embodiment of the present invention is employed.

U.S. Pat. No. 7,383,799, which is incorporated herein by reference in entirety, discloses a system for monitoring changes in the operation of a valve system of an engine. An accelerometer provides vibration-related signals that are obtained by a microprocessor or similarly configured device and compared to a reference or baseline magnitude. The obtaining step can comprise the steps of measuring, filtering, rectifying, and integrating individual data points obtained during specific windows of time determined as a function of the rotational position of the crankshaft of the engine. These windows in time are preferably selected as a function of the position of exhaust or intake valves as they move in response to rotation of cams of the valve system.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A lash adjustment device is for an engine valve train. The lash adjustment device comprises an external hollow body and a ball shaft that is telescopically movable in the hollow body. The ball shaft has a through-bore for receiving oil and has an annular lower end surface and an upper end surface. Oil flow into the hollow body pushes on the lower end surface and forces the ball shaft to telescope outwardly with respect to the hollow body. An absence of oil flow in the external hollow body allows the ball shaft to telescope inwardly with respect to the hollow body until the annular lower end surface engages with an internal stop surface formed in the hollow body.

In some examples, a valve train apparatus can be for a vertically-oriented engine, in for example an outboard motor arrangement. In other examples, the valve train apparatus can be for a horizontally-oriented engine. The valve train apparatus can include (1) a roller that engages with a cam lobe of a cam shaft and (2) a rocker arm that carries the roller and has a first end for engagement with an engine valve that is biased into a closed position, wherein engagement between the roller and cam lobe opens the engine valve, and a second end for engagement with a lash adjuster for adjusting mechanical lash between the roller and the cam lobe. The lash adjuster can have a hollow body and a ball shaft that is telescopically movable in the hollow body. The ball shaft has a through-bore for receiving oil and has an annular lower end surface and an upper end surface. Oil flow into the hollow body forces the ball shaft to telescope outwardly with respect to the hollow body and causes the upper end surface to engage the second end of the rocker arm to reduce mechanical lash. An absence of oil flow in the external hollow body allows the ball shaft to telescope inwardly with respect to the hollow body and thereby increase mechanical lash until the annular lower end surface engages with an internal stop surface formed in the hollow body.

In other examples, methods of making a valve train apparatus are provided. The methods can comprise: (1) providing a roller that engages with a cam lobe of a cam shaft; (2) providing a rocker arm that carries the roller and has a first end for engagement with an engine valve that is biased into a closed position, wherein engagement between the roller and cam lobe opens the engine valve, and a second end for engagement with a lash adjuster for adjusting mechanical lash between the roller and the cam lobe; and (3) providing the lash adjuster with a hollow body and a ball shaft that is telescopically movable in the hollow body, the ball shaft having a through-bore for receiving oil and having an annular lower end surface. Oil flow into the hollow body forces the ball shaft to telescope outwardly with respect to the hollow body and engage the second end of the rocker arm to reduce mechanical lash. The hollow body and through-bore together define a clear passage through the lash adjustment device. An absence of oil flow in the external hollow body allows the ball shaft under force of gravity to telescope inwardly with respect to the hollow body and increase mechanical lash until the annular lower end surface engages with an internal stop surface formed in the hollow body. The method can further comprise selecting a location of the internal stop surface as a function of a desired mechanical lash at startup of the marine engine.

BRIEF DESCRIPTION OF THE DRAWINGS

Examples of valve train apparatuses and methods for making valve train apparatuses are described with reference to the following drawing FIGURES. The same numbers are used throughout the FIGURES to reference like features and components.

DETAILED DESCRIPTION OF THE DRAWINGS

In the present Detailed Description, certain terms have been used for brevity, clearness and understanding. No unnecessary limitations are to be implied therefrom beyond the requirement of the prior art because such terms are used for descriptive purposes only and are intended to be broadly construed. The different apparatuses and methods described herein may be used alone or in combination with other apparatuses and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
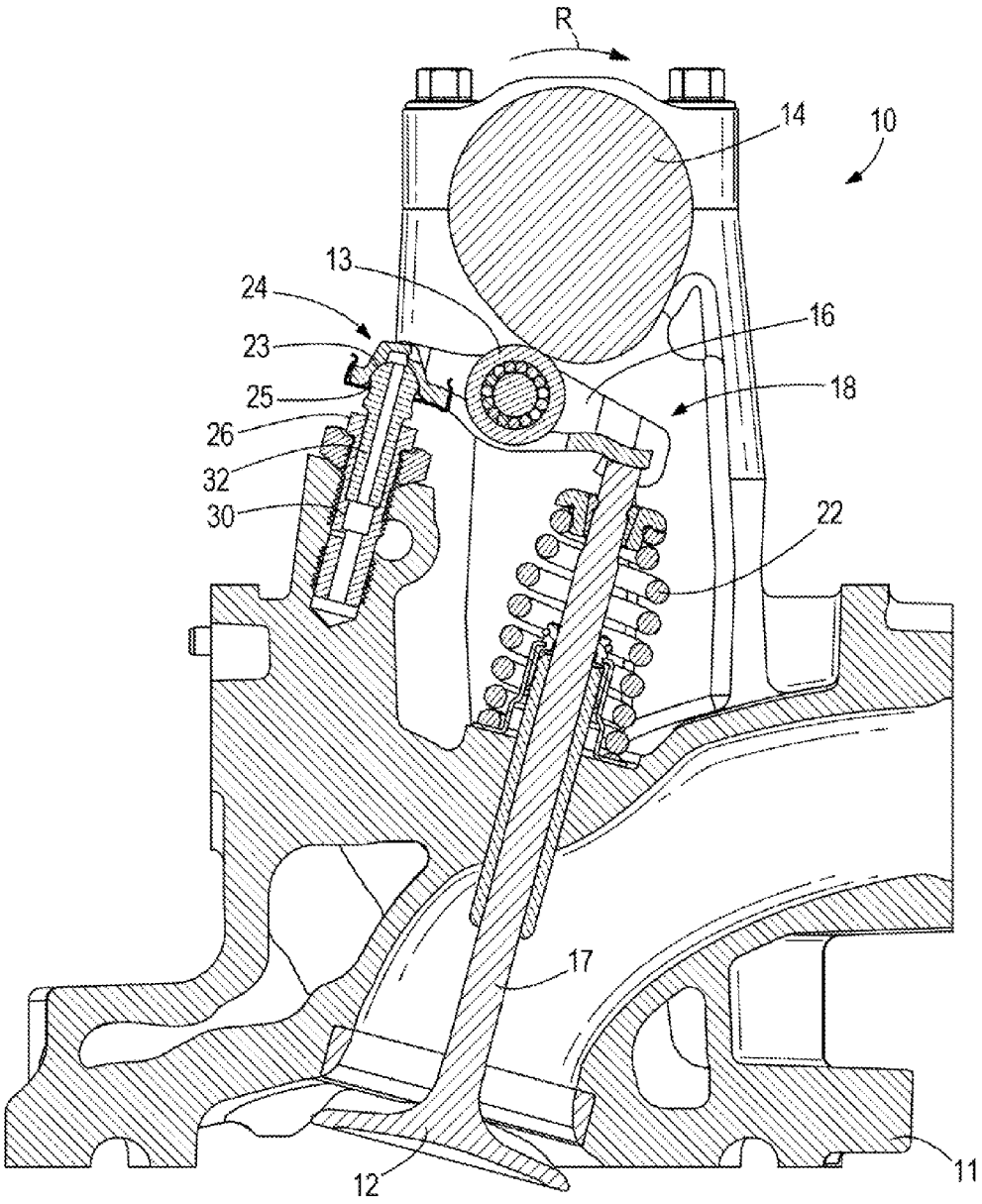
FIG. 1 is a sectional view of a valve train apparatus for a vertically-oriented marine engine.
Figure 2:
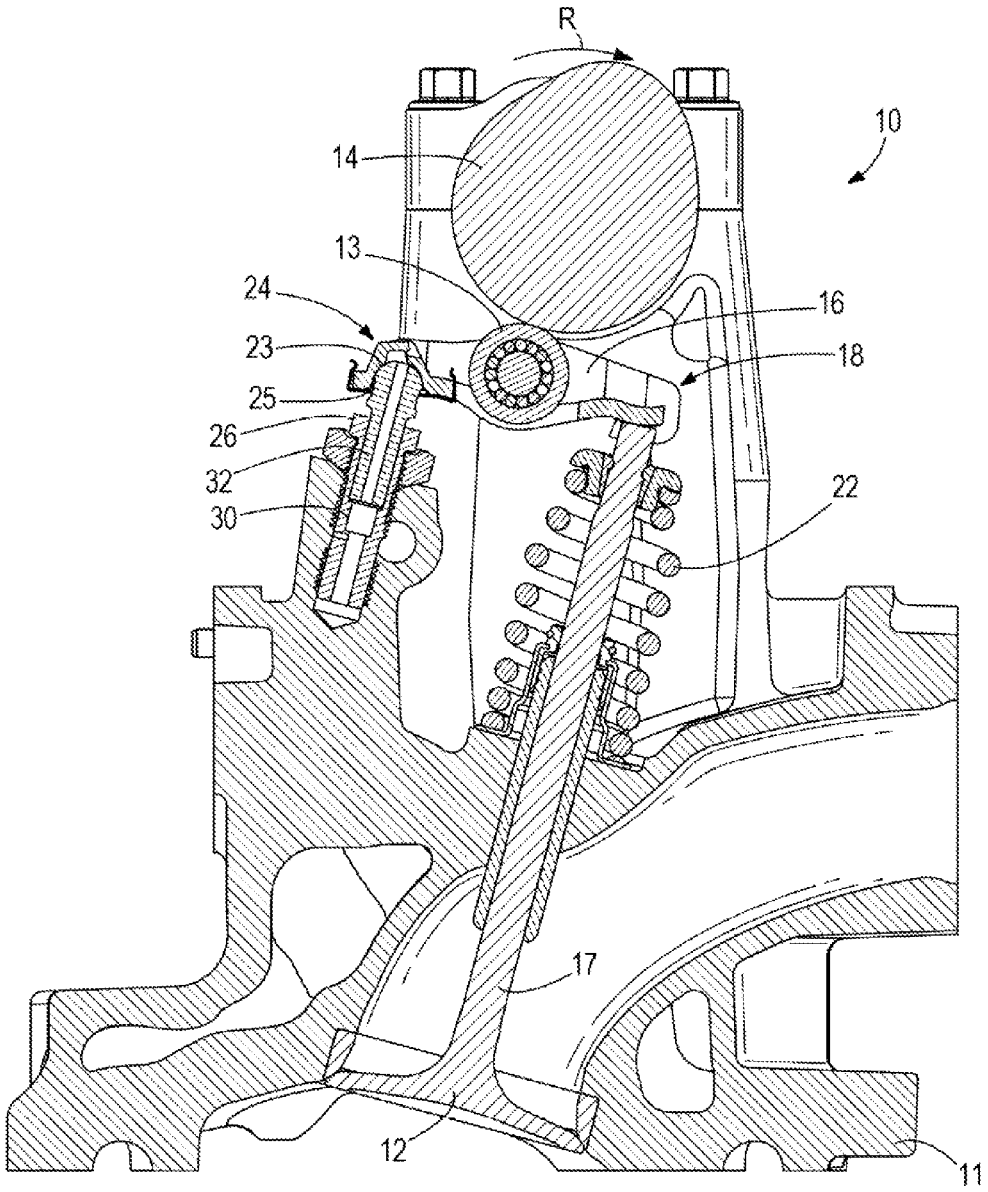
FIG. 2 is another sectional view of the valve train apparatus showing a rocker arm and lash adjuster in a different position when compared to FIG. 1.

FIGS. 1 and 2 are sectional views of a valve train apparatus 10 for a vertically-oriented marine engine 11. The valve train apparatus 10 includes a conventional engine valve 12 that lets an air/fuel mixture into the engine 11 and/or exhaust out of the engine 11. The valve train apparatus 10 has a roller 13 that engages with a cam lobe 14 of a cam shaft. A rocker arm 16 carries the roller 13. The rocker arm 16 has a first end 18 for engagement with the engine valve 12. The engine valve 12 is biased into a closed position shown in FIG. 2 by a conventional valve spring 22. Rotation of the cam shaft rotates the cam lobe 14 as shown by arrow R. As the cam lobe 14 rotates, it cams the roller 13 and forces the first end 18 of the rocker arm 16 against the shaft 17 of the engine valve 12 and against the bias of the valve spring 22, to thereby move the engine valve 12 into the open position, as shown in FIG. 1. Further rotation of the cam lobe 14 in the direction of arrow R releases the cam pressure on the roller 13 and thereby allows the bias of the valve spring 22 to close the engine valve 12 into the closed position shown in FIG. 2. This cycle repeats during operation of the engine 11. This type of arrangement is also disclosed in the incorporated U.S. Pat. No. 8,056,518.

The rocker arm 16 also has a second end 24, which is opposite of the first end 18. A lash adjuster 26 engages a dimple 23 on the lower surface 25 of the second end 24. The lash adjuster 26 is configured for adjusting mechanical lash between the roller 13 and the cam lobe 14, as will be discussed further herein below.

Figure 6:
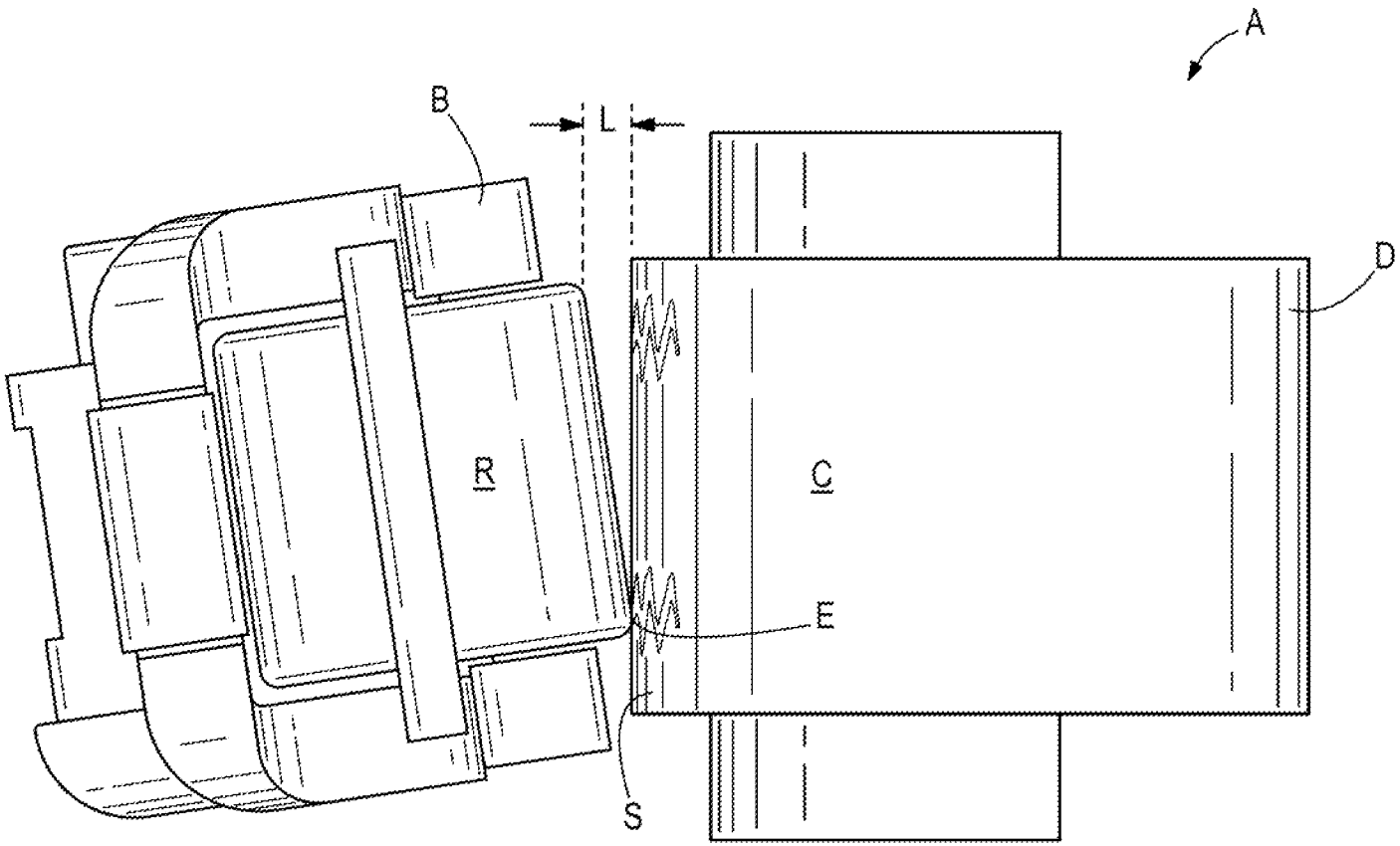
FIG. 6 PRIOR ART
FIG. 6 is a top view of a prior art rocker arm in a prior art valve train apparatus.

Referring to FIG. 6, valve train apparatuses A often have open space, or lash L, built into the valve train apparatus A between the roller R of the rocker arm B and base circle C of the cam lobe D. When the rocker arm B acts as a valve lifter, a mechanical lash L exists between the roller R of the rocker arm B and the base circle C of the cam lobe D. Lash L is needed to prevent unintended valve openings during warm-up of the engine due to thermal expansion differences between the engine valve and a cylinder head of the engine. For example, exhaust valves typically heat up more quickly than the cylinder head, which causes a thermal length growth difference between the exhaust valve and the cylinder head. This thermal length growth difference can result in undesirable opening of the valve. Thus lash L is needed in valve train apparatuses to prevent undesirable valve openings.

However, the present inventors have found that with normal vibration associated with a running engine, the lash L can allow the roller R of the rocker arm B to rock, or lean against the surface S of the cam lobe D. This rocking can lead to an edge E of the roller R engaging the surface S of the cam lobe D (edge-to-surface engagement, rather than surface-to-surface engagement between the roller R and the cam lobe D). This edge-to-surface engagement, as shown in FIG. 6, creates an area of high stress, which may lead to undesirable pitting, or wear on the surface of the cam lobe D and premature failure of bearings associated with the rocker arm B. These problems can occur in both horizontally-oriented valve trains (common in automobile engines) and vertically-oriented valve trains (common in marine outboard engines), but are magnified significantly in a vertically-oriented valve train of vertically-oriented internal combustion engines.

Hydraulic lash adjusters (HLA) have been provided in conventional valve trains to ensure that the roller R of the rocker arm B stays in contact with (or follows closely along with) the cam lobe D. Conventional HLAs often include a check ball that prevents oil from flowing back out of the HLA when it is pressurized. This provides creates a substantially rigid body (as oil is substantially incompressible) that pushes against the cam lobe D for a "zero lash" relationship. Examples of HLAs are shown and described in U.S. Pat. Nos. 8,210,144; 7,992,532; 7,845,327; 7,464,679; 7,464,678; and 7,089,900; which are incorporated herein by reference. While HLAs may be effective in horizontally-oriented valve trains of automotive engines, HLAs are expensive and can create problems when used with vertically-oriented valve trains, which are common in most marine outboard engines. When used in vertically-oriented valve trains, the present inventors have found that HLAs are susceptible to oil leak down when the engine is not running. When the engine is not running, gravity tends to pull oil in the system to the lowest point. In a vertically-oriented valve train, this typically means that the HLAs are substantially drained of oil and exert no pressure on the cam lobe D. This loss of the HLAs internal oil pressure means that the HLA can move up and down freely, movement that may cause the roller R of the rocker arm B to pop out of engagement with the rocker arm B, which is undesirable because the rocker arm B will no longer work as intended. Finally, because H-ILAs usually create a zero lash relationship, the benefits of preventing unintended engine valve openings during engine warm-up is lost.

Through research and development, the present inventors have recognized the above described problems associated with conventional lash adjustment mechanisms and have endeavored to solve these problems.

Figure 3:
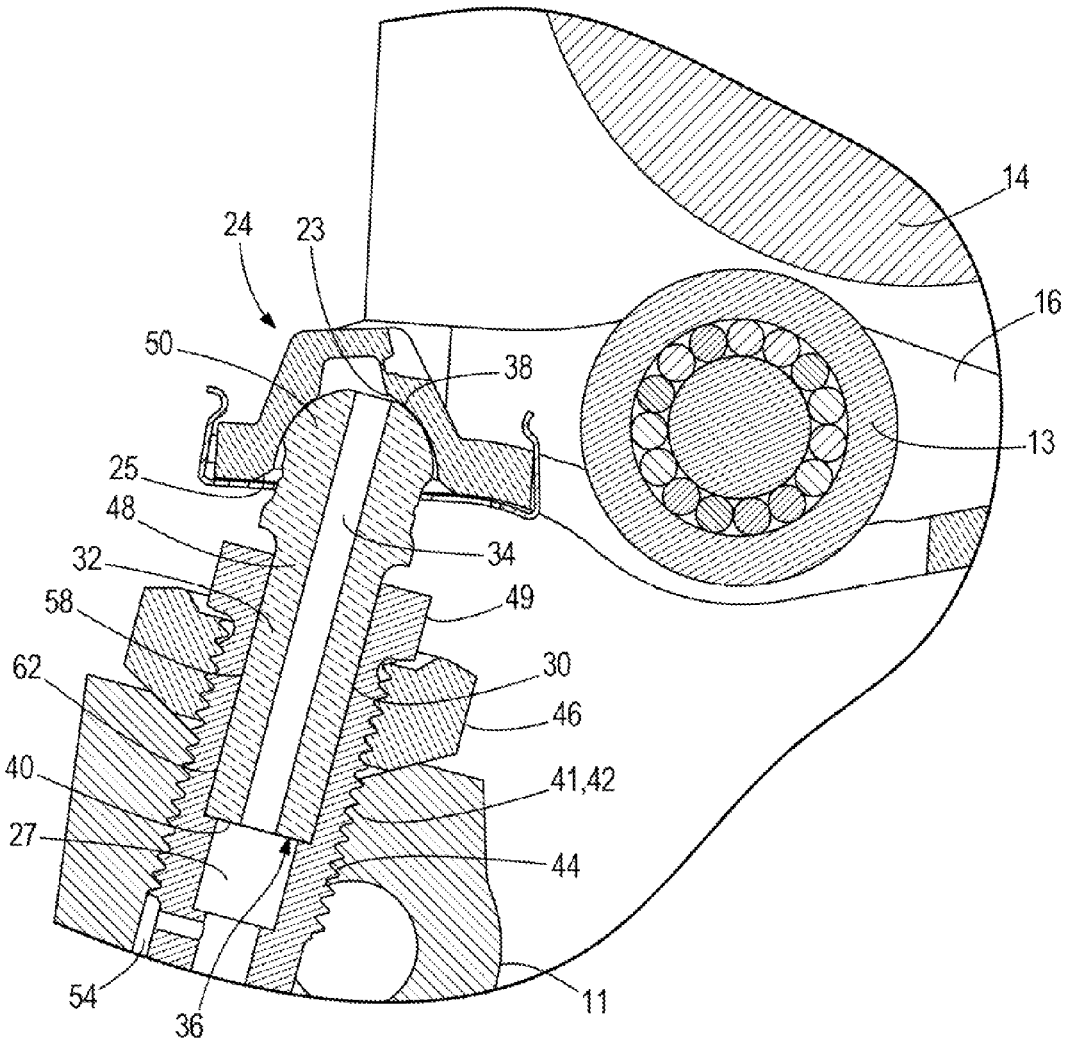
FIG. 3 is a closer sectional view of the rocker arm and lash adjuster in the position shown in FIG. 1.
Figure 4:
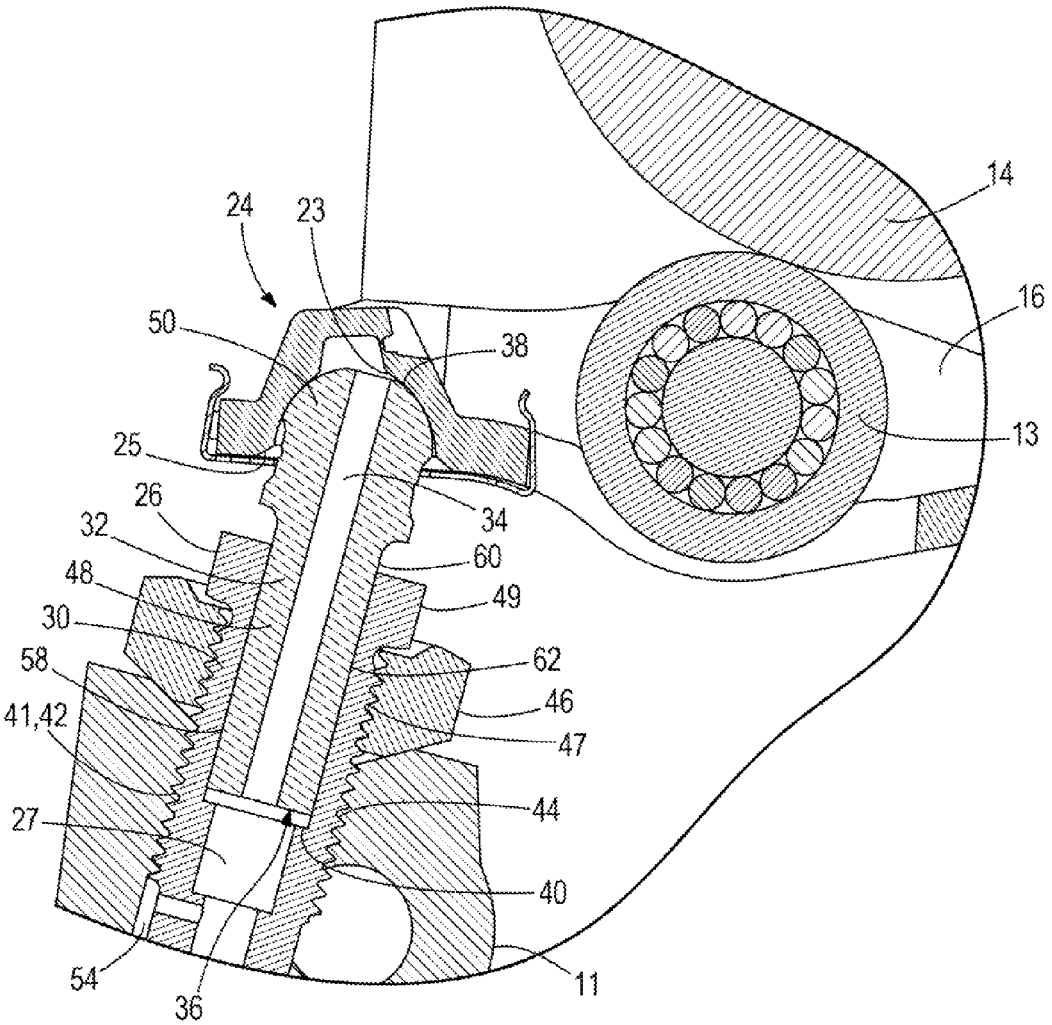
FIG. 4 is a closer sectional view of the rocker arm and lash adjuster in the position shown in FIG. 2.
Figure 5:
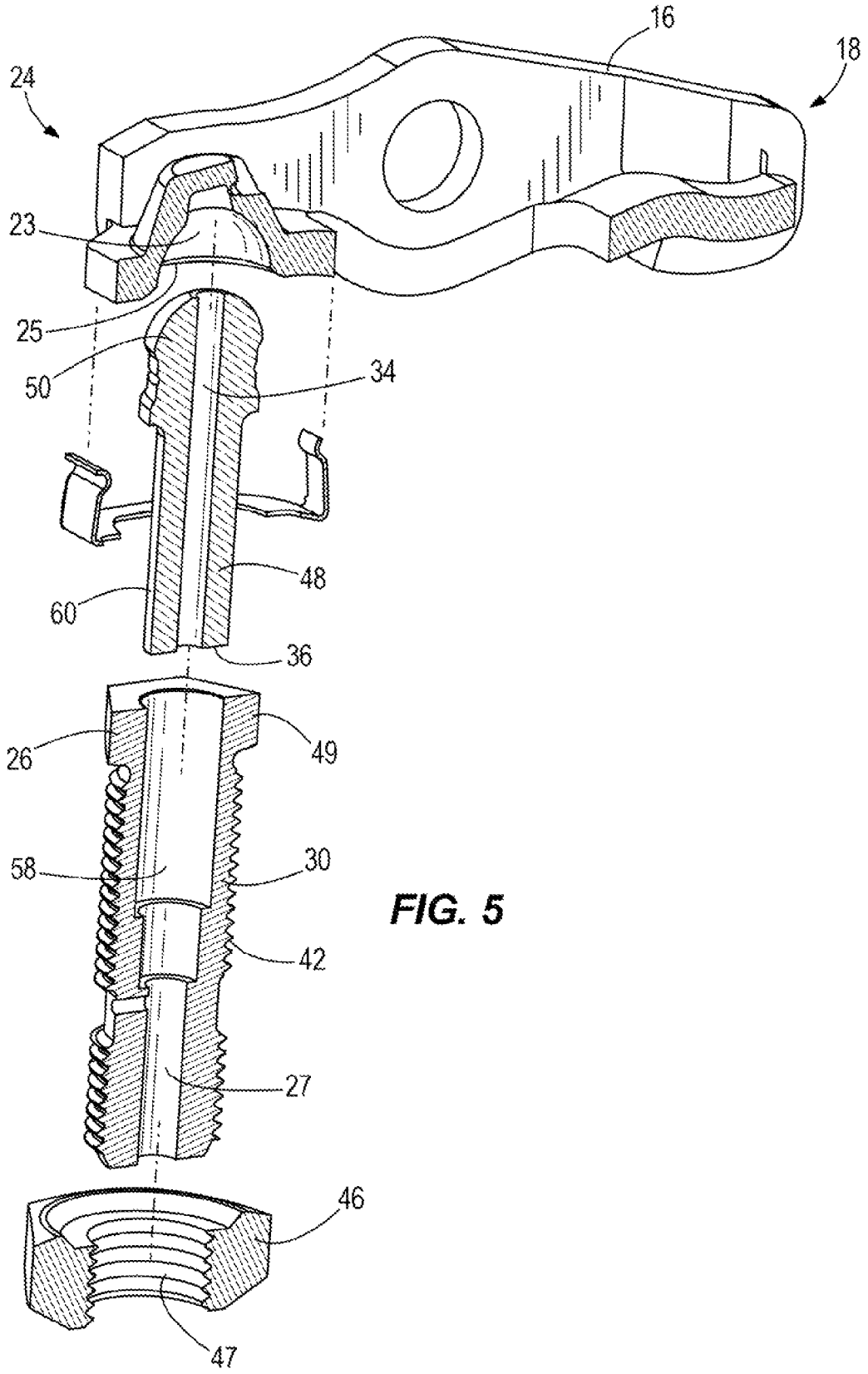
FIG. 5 is an exploded view of the lash adjuster and rocker arm.

As shown in FIGS. 3-5, the lash adjuster 26 according to the present disclosure includes a hollow body 30 and a ball shaft 32 that is telescopically movable along an inner passage 27 of the hollow body 30. The ball shaft 32 has a through-bore 34, an annular lower end surface 36 and an upper end surface 38. The through-bore 34 has a smaller diameter than the inner passage 27.

The hollow body 30 has an outer threaded surface 42 for engaging with and securing the hollow body 30 with respect to an internally threaded surface 41 on a lifter bore 44 of the marine engine 11. In other examples, the hollow body 30 could be cast into or otherwise form a part of the noted lifter bore 44. In the illustrated example, turning of the hollow body 30 with respect to the lifter bore 44 threads and unthreads the hollow body 30 into and out of the lifter bore 44 to decrease and increase mechanical lash L, respectively. The hollow body 30 has a hexagon shaped head 49 for engagement with a wrench for manually loosening and tightening the noted engagement between threaded surfaces 41, 42. A conventional jam nut 46 has an internally threaded surface 47 that engages with the outer threaded surface 42 on the hollow body 30 and further secures the hollow body 30 in the lifter bore 44 of the marine engine 11.

The ball shaft 32 has an elongated shaft 48 that extends into the hollow body 30 and a spherical head 50 that is located outside of the hollow body 30. The spherical head 50 engages with the dimple 23 on the lower surface 25 of the second end 24 of the rocker arm 16. Together, the inner passage 27 and through-bore 34 extend through both the shaft 48 and the spherical head 50, such that the hollow body 30 and the ball shaft 32 together define a clear passage through the lash adjuster 26. The hollow body 30 has a smooth internal circumferential surface 58. The ball shaft 32 has a smooth external circumferential surface 60 that can axially slide with respect to the smooth internal circumferential surface 58 when the ball shaft 32 is placed under pressure. The ball shaft 32 thus telescopically moves with respect to the hollow body 30. A small gap 62 exists between the smooth internal circumferential surface 58 and smooth external circumferential surface 60 and as explained further herein below, oil can flow into the noted gap 62 to lubricate and enhance the telescoping movement of the ball shaft 32.

In use, oil flows from the engine 11 into the inner passage 27 of the hollow body 30 and then into the through-bore 34. Oil enters the lifter bore 44 via a circumferential passage 54 defined between the hollow body 30 and the lifter bore 44. The circumferential passage 54 guides oil flow to an inlet passage 56 connected to the inner passage 27 of hollow body 30. The reduction in flow area from the inner passage 27 to the through-bore 34 causes the oil to apply pressure onto the lower end surface 36 of the ball shaft 32 and push the ball shaft 32 telescopically outwardly with respect to the hollow body 30. The smooth external circumferential surface 60 axially slides with respect to the smooth internal circumferential surface 58 and the ball shaft 32 telescopically moves with respect to the hollow body 30. Oil also flows into the noted gap 62 between the smooth internal circumferential surface 58 and smooth external circumferential surface 60, lubricating and thereby enhancing the telescope-ability. Outward telescoping movement of the ball shaft 32 pushes the second end 24 rocker arm 16, thereby reducing the noted mechanical lash L.

When the engine 11, stops, reduction or absence of oil flow into the hollow body 30 allows the ball shaft 32 under force of gravity and under force of the valve spring 22 to telescope back inwardly with respect to the hollow body 30, thus relieving pressure on the second end 24 of the rocker arm 16 and increasing the mechanical lash L until the annular lower end surface 36 engages with an internal stop surface 40 formed in the hollow body 30.

As discussed above, the amount of mechanical lash can be adjusted by rotating the hollow body 30 with respect to the lifter bore 44. In addition, when making the valve train apparatus 10, the location of the internal stop surface 40 can be selected as a function of a desired mechanical lash at startup of the engine 11.

The apparatus shown in the above-described FIGURES thus overcomes many of the above-described problems associated with the prior art by providing a valve train apparatus for setting and maintaining mechanical lash in a valve train, while not having its performance negatively affected by oil leak down in a vertically-oriented valve train. The threaded engagement between the hollow body 30 and the lifter bore 44 allows for easy adjustment of lash L and solid, stable setting of lash L. The jam nut 46 also threadably engages the outer threaded surface 42 to hold the hollow body 30 securely in place, establishing a consistent lash L. The lash adjuster 26 does not require a check ball to prevent oil from flowing out when pressurized, and therefore the apparatus does not become as rigid as conventional HLAs. Further, the lash adjuster 26 provides a hard, consistent lash L and is not negatively impacted by oil leak down. The apparatus helps ensure consistent surface-to-surface contact between the roller 13 of the rocker arm 16 and the cam lobe 14, thereby increasing the life of the cam shaft and the rocker arm 16. This arrangement can be suitable for both vertically and horizontally-oriented valve trains, but can be particularly useful for vertically-oriented valve trains of marine outboard engines.

What is claimed is:

1. A method of making a valve train apparatus for an engine, the method comprising:

providing a roller that engages with a cam lobe of a cam shaft;

providing a rocker arm that carries the roller and has a first end for engagement with an engine valve that is biased into a closed position, wherein engagement between the roller and cam lobe opens the engine valve, and a second end for engagement with a lash adjuster for adjusting mechanical lash between the roller and the cam lobe;

providing the lash adjuster with a hollow body and a ball shaft that is telescopically movable in the hollow body, the ball shaft having a through-bore for receiving oil and having an annular lower end surface;

wherein oil flow into the hollow body forces the ball shaft to telescope outwardly with respect to the hollow body and engage the second end of the rocker arm to reduce mechanical lash;

wherein the hollow body and through-bore together define a clear passage through the lash adjustment device; and wherein the lash adjuster is configured such that an absence of oil flow in the external hollow body allows the ball shaft to telescope inwardly with respect to the hollow body and increase mechanical lash until the annular lower end surface engages with an internal stop surface formed in the hollow body; and selecting a location of the internal stop surface as a function of a desired mechanical lash at startup of the engine.

* * * * *